US010753264B2

(12) United States Patent
Klemenc et al.

(10) Patent No.: US 10,753,264 B2
(45) Date of Patent: Aug. 25, 2020

(54) EXHAUST SYSTEM FOR AN INTERNAL COMBUSTION AUTOMOTIVE ENGINE

(71) Applicant: Akrapovic d.d., Ivancna Gorica (SI)

(72) Inventors: Jaka Klemenc, Ivancna Gorica (SI); Matej Bulc, Ivancna Gorica (SI)

(73) Assignee: Akrapovic d.d., Ivancna Gorica (SI)

( * ) Notice: Subject to any disclaimer, the term of this patent is extended or adjusted under 35 U.S.C. 154(b) by 297 days.

(21) Appl. No.: 15/743,995

(22) PCT Filed: Jul. 13, 2016

(86) PCT No.: PCT/EP2016/066666
§ 371 (c)(1),
(2) Date: Jan. 11, 2018

(87) PCT Pub. No.: WO2017/009381
PCT Pub. Date: Jan. 19, 2017

(65) Prior Publication Data

US 2018/0202344 A1 Jul. 19, 2018

(30) Foreign Application Priority Data

Jul. 16, 2015 (EP) ..... 15002592

(51) Int. Cl.
*F01N 13/02* (2010.01)
*F01N 13/04* (2010.01)
(Continued)

(52) U.S. Cl.
CPC ..... *F01N 13/04* (2013.01); *F01N 1/023* (2013.01); *F01N 1/06* (2013.01); *F01N 1/166* (2013.01);
(Continued)

(58) Field of Classification Search
CPC . F01N 1/06; F01N 1/166; F01N 1/023; F01N 13/04; F01N 13/011; F01N 13/009;
(Continued)

(56) References Cited

U.S. PATENT DOCUMENTS 5,085,049 A * 2/1992 Rim ..... F01N 3/02 55/466
5,144,799 A * 9/1992 Barth ..... F01N 13/04 60/313
(Continued)

FOREIGN PATENT DOCUMENTS

CN 101943046 A 1/2011
CN 203321666 U 12/2013
(Continued)

OTHER PUBLICATIONS

International Search Report for corresponding International Application No. PCT/EP2016/066666 dated Sep. 15, 2016; 3 pages.
(Continued)

*Primary Examiner* — Thai Ba Trieu
*Assistant Examiner* — Dapinder Singh
(74) *Attorney, Agent, or Firm* — Patterson Thuente Pedersen, P.A.

(57) ABSTRACT

An exhaust system for an internal combustion automotive engine, comprising: a left exhaust tract connected or to be connected to a left group of cylinder of the internal combustion automotive engine and a right exhaust tract connected or to be connected to a right group of cylinder of the internal combustion automotive engine, the left and right exhaust tracts, each comprising a branching structure defining a tract inlet, at least one exhaust outlet directly or indirectly opening into atmosphere, and an interconnecting outlet interconnecting said left and right exhaust tracts, wherein said interconnecting outlets are interconnected with
(Continued)

each other by a common exhaust gas cleaning and/or silencing device downstream said interconnecting outlets such that exhaust gas flows coming from said interconnecting outlets are unified within said common exhaust gas cleaning and/or silencing device.

13 Claims, 3 Drawing Sheets

(51) Int. Cl.

| | |
|---|---|
| ***F01N 13/10*** | (2010.01) |
| ***F01N 1/02*** | (2006.01) |
| ***F01N 1/16*** | (2006.01) |
| ***F01N 13/00*** | (2010.01) |
| ***F01N 1/06*** | (2006.01) |

(52) U.S. Cl.
CPC ..... *F01N 13/009* (2014.06); *F01N 13/011* (2014.06); *F01N 13/02* (2013.01); *F01N 13/107* (2013.01); *F01N 2240/36* (2013.01); *F01N 2470/14* (2013.01)

(58) Field of Classification Search
CPC .... F01N 13/107; F01N 13/02; F01N 2470/14; F01N 2240/36
USPC ..... 60/323
See application file for complete search history.

(56) References Cited

U.S. PATENT DOCUMENTS

| | | | | |
|---|---|---|---|---|
| 5,325,666 | A * | 7/1994 | Rutschmann | F01N 3/28 123/692 |
| 7,640,728 | B2 * | 1/2010 | Yoshizaki | B01D 53/9431 60/286 |
| 8,341,946 | B2 * | 1/2013 | Harmsen | B01D 53/9431 60/274 |
| 9,605,580 | B2 * | 3/2017 | Drees | F01N 13/02 |
| 9,945,280 | B2 * | 4/2018 | Eichmueller | F01N 13/02 |
| 2002/0100273 | A1 * | 8/2002 | Bubeck | F01N 3/2006 60/287 |
| 2011/0000201 | A1 | 1/2011 | Laube et al. | |
| 2016/0053658 | A1 | 2/2016 | Drees et al. | |

FOREIGN PATENT DOCUMENTS

| | | | |
|---|---|---|---|
| DE | 10 2013 208 946 | A1 | 11/2014 |
| EP | 2287452 | A1 | 2/2011 |
| EP | 2733322 | A1 | 5/2014 |
| TW | 200912124 | A | 3/2009 |
| WO | WO 2015/128816 | A2 | 9/2015 |

OTHER PUBLICATIONS

Written Opinion of the International Searching Authority for corresponding International Application No. PCT/EP2016/066666 dated Sep. 15, 2016; 6 pages.
Extended European Search Report for corresponding EP Application No. 15002592.2 dated Jan. 7, 2016; 7 pages.
Examination Report for corresponding Taiwanese Application No. 105122149 dated Nov. 22, 2017; 10 pages.

* cited by examiner

EXHAUST SYSTEM FOR AN INTERNAL COMBUSTION AUTOMOTIVE ENGINE

CROSS-REFERENCE TO RELATED APPLICATIONS

The present application is a National Phase entry of PCT Application No. PCT/EP2016/066666, filed on Jul. 13, 2016, which claims priority to EP Patent Application No. 15002592.2, filed on Jul. 16, 2015, which are hereby fully incorporated herein by reference.

TECHNICAL FIELD

The invention refers to an exhaust system for an internal combustion automotive engine. The exhaust system comprises a left exhaust tract connected or to be connected to a left group of cylinders of the internal combustion automotive engine and a right exhaust tract connected or to be connected to a right group of cylinders of the internal combustion automotive engine.

BACKGROUND

In U.S. Pat. No. 5,144,799 a dual-exhaust system for an internal combustion automotive engine is described. By a pipe intersection in an X-configuration, the left and right exhaust tracts are connected with each other. Branching pipes of the pipe intersection are coupled at substantially a 45° angle with respect to each of the branching pipes and at substantially a 90° angle with respect to each other. The pipe intersection is provided for mixing and equalizing the pressure within the two left and right exhaust pipes.

US 2011/0000201 A1 discloses such an exhaust system according to the first part of main claim. The exhaust system is defined to have a left and right exhaust track each of them comprising a branching structure defining a tract inlet and at least one exhaust outlet directly or indirectly opening into the atmosphere, and an interconnecting outlet. The interconnecting outlet interconnects the left and right exhaust tracts by a connecting line. At a point of connection of both connecting lines a bypass line branches off that can be connected to an exhaust gas purification device or a catalytic converter or a silencer or muffler.

It is an object of the invention to overcome disadvantages of the prior art, particularly to provide an improved exhaust system for an internal combustion automotive engine, particularly to provide an exhaust system which is improved regarding noise reduction while simultaneously the exhaust system does not impair engine power.

SUMMARY

According to embodiments of the invention, an exhaust system for an internal combustion automotive engine is provided that comprises a left exhaust tract connected or to be connected to a left group of cylinders of the internal combustion automotive engine and a right exhaust tract connected or to be connected to a right group of cylinders of the internal combustion automotive engine. Each of the left and right exhaust tracts comprises, downstream of the respective group of cylinders, a branching structure defining a tract inlet receiving exhaust gas from the respective left or right group of cylinders. Further, each branching structure comprises at least one exhaust outlet, preferably two exhaust outlets directly and/or indirectly opening into the atmosphere. Particularly, one exhaust outlet opens into the atmosphere and is merely connected to a line or pipe exiting to the atmosphere without passing an exhaust manipulating device. An exhaust manipulating device can be an exhaust gas purification device, an exhaust gas cleaning device and/or an exhaust gas silencing device. An indirect opening into the atmosphere shall be considered if between the atmosphere and the exhaust outlet an exhaust gas manipulating device is interposed.

Further, each branching structure of the left and right exhaust tract defines an interconnecting outlet interconnecting the left and right exhaust tracts such that one part of the exhaust gas flow from the respective left and right exhaust tract is leaving the branching structure for being interconnected and unified with the respective other exhaust gas flow that is branched off. According to embodiments of the invention the interconnecting outlets are interconnected with each other by a common exhaust gas cleaning and/or silencing device downstream of the interconnecting outlets such that exhaust gas branched off and flowing via the interconnecting outlets are unified within the common exhaust gas cleaning and/or silencing device. The unification of exhaust gas flows branched off is not realized until the exhaust gas flows branched off will have entered the common exhaust gas cleaning and/or silencing device which can be preferably a muffler and/or a catalytic converter. The first and second exhaust tracts are partly (depending on the branch ratio) unified inside the middle exhaust gas manipulating device, as the middle muffler. According to the invention, a common bypass line as proposed in existing exhaust systems can be neglected. Rather, it turned out that an immediate mixture of the exhaust gas flows coming from the left and right exhaust tracts after having been branched off at the respective branching structure, inside the middle exhaust gas manipulating device improves the silencing and cleaning effectiveness of the exhaust system. The common exhaust gas cleaning and/or silencing device can be realized as a common muffler designed to cancel unwanted frequencies so as to improve the cabin comfort, however, without effecting particularly a sporty exhaust note to the exhaust system. The middle muffler can be designed to provide the function of a Helm-Holtz resonator. The exhaust gas cleaning and/or silencing device can provide an expansion within a housing of the device so that gas pressure peaks are smoothened.

According to a further development of embodiments of the invention, the common exhaust gas cleaning and/or silencing device comprises an at least exhaust gas proof, preferably gas tight, housing and/or a left and a right interconnecting inlet, particularly formed in the gas tight housing. Interconnecting pipes or lines are connected to the interconnecting inlets. Further or alternatively, the common exhaust gas cleaning and/or silencing device comprise a left returning outlet and a right returning outlet reconnecting the common exhaust gas cleaning and/or silencing device to the respective left and right exhaust tract, particularly to the respective branching structure. As mentioned above, the common exhaust gas cleaning and/or silencing device can internally be fitted at least with two internal intersecting pipes connecting the respective left and right interconnecting inlets with the right and left returning outlets of the common exhaust gas cleaning and/or silencing device and particularly forming the intersection of pipes, preferably as an X-formed intersection.

According to a further development of embodiments of the invention, the common exhaust gas cleaning and/or silencing device comprises a closed, gas tight or exhaust gas proof housing constructed with at least two interconnecting inlets and at least two returning outlets for interconnecting and reconnecting the housing with the left and right exhaust tract particularly at the respective branching structure.

According to a preferred embodiment of the invention, the respective branching structure of the left and right exhaust tract is formed by a respective gas exhaust manipulating device as a left and right gas exhaust cleaning and/or silencing device, particularly as a catalyzer or muffler, respectively.

According to a preferred embodiment of the invention, the left and right branching structures each additionally comprises a reconnecting inlet reconnecting the common exhaust gas cleaning and/or silencing device with the associated branching structures particularly such that a main part of exhaust gas from the respective interconnecting outlet of the left exhaust tract is conducted to the respective reconnecting inlet associated to the branching structure of the right exhaust tract and vice versa. Therefore, the common gas exhaust cleaning and/or silencing device is designed to exchange the main part of exhaust gas branched off between the left and right exhaust tract. A main part can be considered that more than 50% of the exhaust gas from the left exhaust tract is guided to the right exhaust tract and vice versa.

According to a further development of embodiments of the invention, the exhaust gas cleaning and/or silencing device comprises the general internal construction of a muffler and/or one or more intersections of internal pipes or interconnecting pipes being coupled to the interconnecting device inlets and therefore to the respective interconnecting outlets of the branching structure. Particularly the pipe intersection is configured in an X-configuration. Particularly the intersection of pipe is designed such that pulsatile flow of exhaust gas coming from one interconnecting outlet of the respective branching structure, impacts with the other within the intersection of pipes such that the pulsatile flow urges the other via the associated reconnecting outlet of the branching structure to the other exhaust tract. Accordingly, a pulsatile exhaust gas flow arriving at the right tract interconnecting inlet of the common exhaust gas cleaning and/or silencing device, helps the left one and vice versa so that exhaust gas flows of each tract are induced by one another.

According to a preferred embodiment of the invention, all exhaust gas diverging or branching-off at the branching structure from the respective left and right exhaust tract via the interconnecting outlet, enter completely the common exhaust gas cleaning and/or silencing device. Particularly, respective returning outlets of the device being reconnected to respective reconnecting inlets of the branching structure.

According to a preferred embodiment of the invention, the common exhaust gas cleaning and/or silencing device comprises an intersection of pipes and includes two incoming pipes, two outgoing pipes and an intersection pipe structure having a minimal (locally smallest) vertical cross-sectional area and a minimal (locally smallest) horizontal cross-section area wherein one of the cross-section areas, particularly the vertical cross-section area, is larger than the respective other one. Further, particularly one of the cross section areas, particularly the horizontal cross-section area, is smaller than two times of the preferably continuous pipe cross-section and/or the other cross-section area particularly vertical cross-section area. Preferably, the vertical cross-section area is from 0.8 to 1.2 times the size of the cross-section area of each pipe, particularly the continuous pipe cross-section. Preferably, the vertical cross section area is 0.6 to 1.0 times, more preferably approximately 0.8 times, the size of the cross section area of a pipe, in particular of one or both of the incoming pipes and/or of one or both of the outgoing pipes. Preferably, the vertical cross section area is smaller than the horizontal cross section area. The intersection pipe structure is designed to use energy of pressure pulses from one exhaust tract to accelerate exhaust gas coming from the opposite exhaust tract. This function should be called push-pull effect. Besides, the intersection pipe structure optimizes flow properties as one exhaust flow is inducing the other and vice versa. It turned out that both facts increases the engine performance substantially.

According to a preferred embodiment of the invention, the common exhaust gas cleaning and/or silencing device contains an intersection pipe structure providing a flow volume expansion such that a positive pressure of the exhaust gas entering the pipe intersection is at least partially inverted into a negative pressure directed backwards in direction of the respective interconnecting inlet of said common exhaust gas cleaning and/or silencing device.

According to a preferred embodiment of the invention, an interconnecting pipe is provided for coupling the interconnecting outlets of the branching structure to the common exhaust gas cleaning and/or silencing device. The interconnected pipes are provided with a shut-off device in order to activate and deactivate the function of said common exhaust gas cleaning and/or silencing device.

According to a further development of the invention, a left and right reconnecting pipe connect a respective right and left reconnecting outlet of the common exhaust gas cleaning and/or silencing device with a respective reconnecting inlet of the branching structure.

BRIEF DESCRIPTION OF THE FIGURES

Further embodiments, features and technical aspects are described in the sub-claims. Further details of preferred embodiments of the invention are shown in the enclosed figures in which:

DETAILED DESCRIPTION OF EMBODIMENTS

Figure 1:
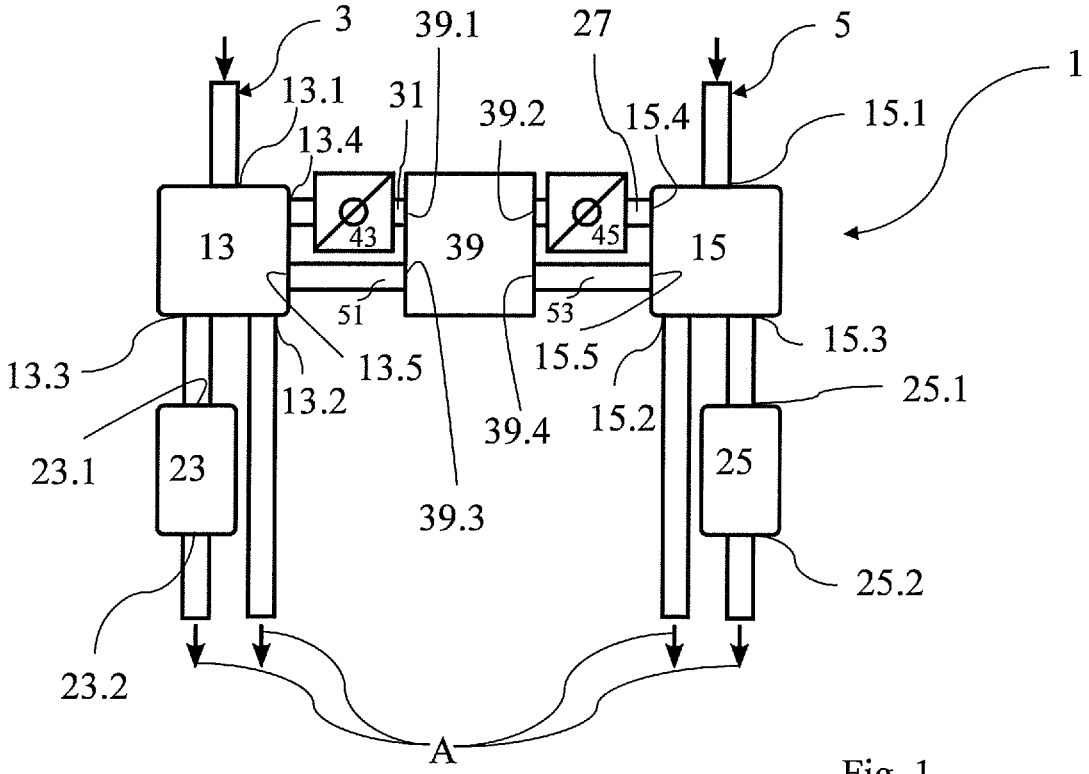
FIG. 1 is a diagrammatic plan of the exhaust system according to a general structure.

In FIG. 1 the exhaust system for an internal combustion automotive engine (not shown) is provided in general with reference number 1. The exhaust system 1 comprises two exhaust tracts, namely a left exhaust tract 3 and a right exhaust tract 5. It is noted that the expression "left" and "right" can indicate the mounting position of the exhaust system and/or the internal combustion engine, however, even two cylinder groups which are orientated in a vertical direction or in another direction can be considered to be left or right in order to distinguish the two separated group of cylinders and exhaust tracts 3, 5.

Each exhaust tract 3, 5 includes a left and right branching structure, respectively. Each branching structure can be denoted as an exhaust subassembly 13, 15 which realizes an exhaust gas manipulating function, as an exhaust cleaner or silencer, a muffler. The respective (first) exhaust subassembly 13, 15 comprises a tract inlet 13.1, 15.1, two exhaust outlets 13.2, 13.3, 15.2, 15.3 and an interconnecting outlet 13.4, 15.4 and a reconnecting inlet 13.5, 15.5. The first exhaust subassembly 13, 15 divides the respective exhaust gas flows in the exhaust tracts 3, 5 such that one part of the exhaust gas flows is directed via the interconnecting outlets 13.4; 15.4, while the other part of the exhaust gas flow is directed to the respective outlets 13.2; 13.3; 15.2; 15.3.

The respective exhaust outlet 13.2, 15.2 directly opens to atmosphere indicated by A. The second left and right exhaust outlet 13.3, 15.3 opens indirectly to atmosphere A via a second left and right exhaust subassembly 23, 25 preferably being an exhaust cleaner or silencer. The respective exhaust subassembly is formed with an inlet 23.1, 25.1 and an outlet 23.2 and 25.2.

The interconnecting outlet 13.4 and 15.4 are coupled via a left and right interconnecting pipe 27, 31 with a common exhaust gas cleaning and/or silencing device such that left and right exhaust gas flows branched off via the interconnecting outlets 13.4; 15.4 are unified within the common exhaust gas cleaning and/or silencing device. The unification is realized not until both branched off gas exhaust flows have entered the common exhaust gas cleaning and/or silencing device. The common exhaust gas cleaning and/or silencing device is preferably a muffler and/or a catalytic converter and shall be denominated middle unifying exhaust subassembly 39 in the following. As mentioned, the middle unifying exhaust subassembly 39 could be designed as a muffler, an exhaust cleaner or silencer and having a left and right branch inlet 39.1, 39.2 and a left and right branch outlet 39.3, 39.4. The branch outlets 39.3 and 39.4 are coupled with reconnecting inlets 13.2, 15.2 of the respective left and right (first) exhaust subassemblies.

The part of the exhaust gas of the exhaust tract 3, 5 branched off into the interconnecting structure via respective interconnecting outlets 13.4, 15.4, are led within interconnecting pipes 27, 31 to a shut-off device 43, 45 arranged in order to stop and let pass exhaust gas flowing to the middle unifying exhaust subassembly 39. The shut-off devices 43, 45 can be controlled by an electronic control system (not shown) operating the respective shut-off devices 43, 45 according to an operation mode of the internal combustion engine and/or the control adjustments or control procedure for the operation of the exhaust system 1.

The middle unifying exhaust subassembly 39 receiving the part of the gas flow of respective left and right tract 3, 5, treats the exhaust flows and conducts the exhaust flow via the respective returning outlets 39.3, 39.4 into reconnecting pipes 51, 53 extending to the reconnecting inlets 13.5, 15.5 of the (first) exhaust subassemblies 13, 15.

By this configuration, even exhaust gas flow deviated from the left and right exhaust tract 3, 5 by the (first) exhaust subassembly 13, 15 is treated by a cleaning function and/or silencing function of the middle unifying exhaust subassembly 39 when being unified and before being re-entered into the common gas flow of the left and right exhaust tract 3, 5.

Particularly, by the middle unifying exhaust subassembly 39 a gas exchange is realized such that the main part of exhaust gas from the left tract 3 is directed to the reconnecting inlet of the right (first) exhaust subassembly 15, vice versa. By this arrangement, a common bypass line having a point of connection is not necessary. All of the exhaust gas will pass the respective (first) right and left exhaust subassemblies 13, 15.

By this arrangement of integrating a middle unifying subassembly 39, surprisingly it was found out that it improves the noise development and on the other hand has a positive effect on the engine power.

Figure 2:
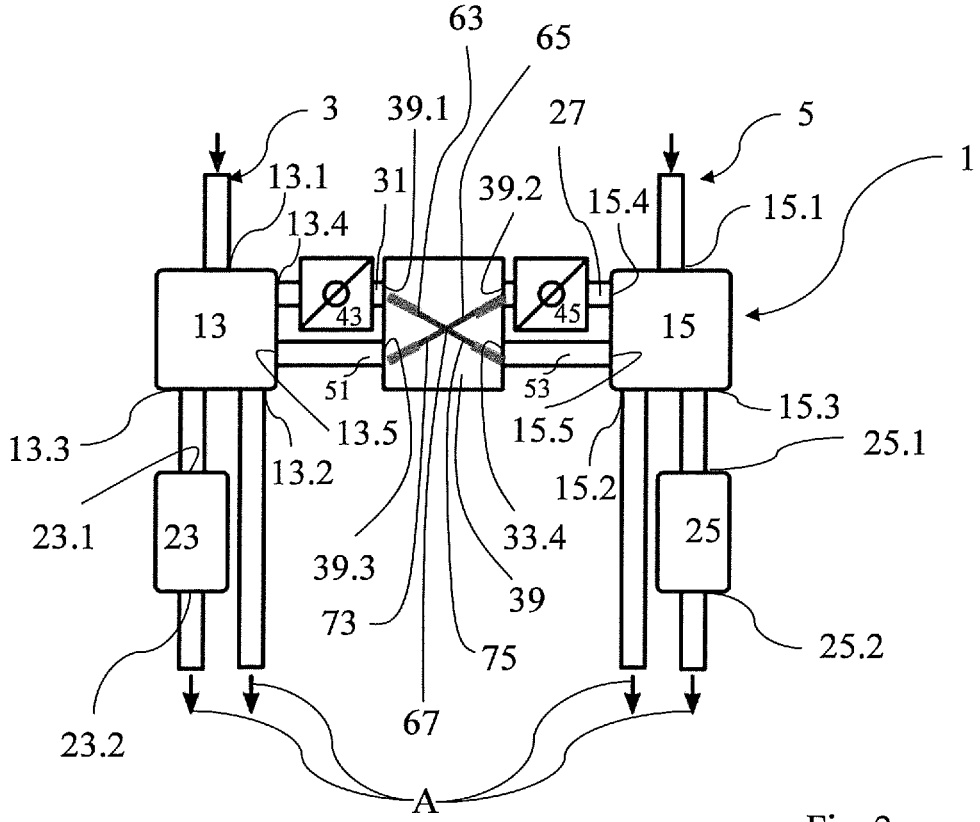
FIG. 2 is a diagrammatic plan of a further, more specific embodiment of the invention.

Referring to FIG. 2, a specific structure of the middle unifying exhaust subassembly 39 is diametrically shown. For a better understanding of the description of figures, in FIG. 2 the same reference signs are used for identifying similar or identical elements or members of the exhaust system 1 according to FIG. 1.

The middle unifying exhaust subassembly 39, i.e. the muffler and/or catalyzer, according to FIG. 2, includes an intersection of pipes being arranged in an X-configuration. The middle unifying subassembly 39 comprises two incoming pipes 63, 65 extending to an internal common intersection point 67 and two leaving pipes 73, 75 extending to the reconnecting pipes 51, 53. The X-configuration of the middle unifying exhaust subassembly 39 has advanced functions in comparison to a simple mixing via a common bypass line. The subassembly 39 provides an exchange of a major amount of exhaust gas being conducted from the right tract 5 into the left tract 3 and vice versa. The X-configuration uses flow energy of pressure pulses from one exhaust tract 3 to accelerate the gas flow coming from the opposed exhaust tract 5 ("push-pull effect").

Figure 4:
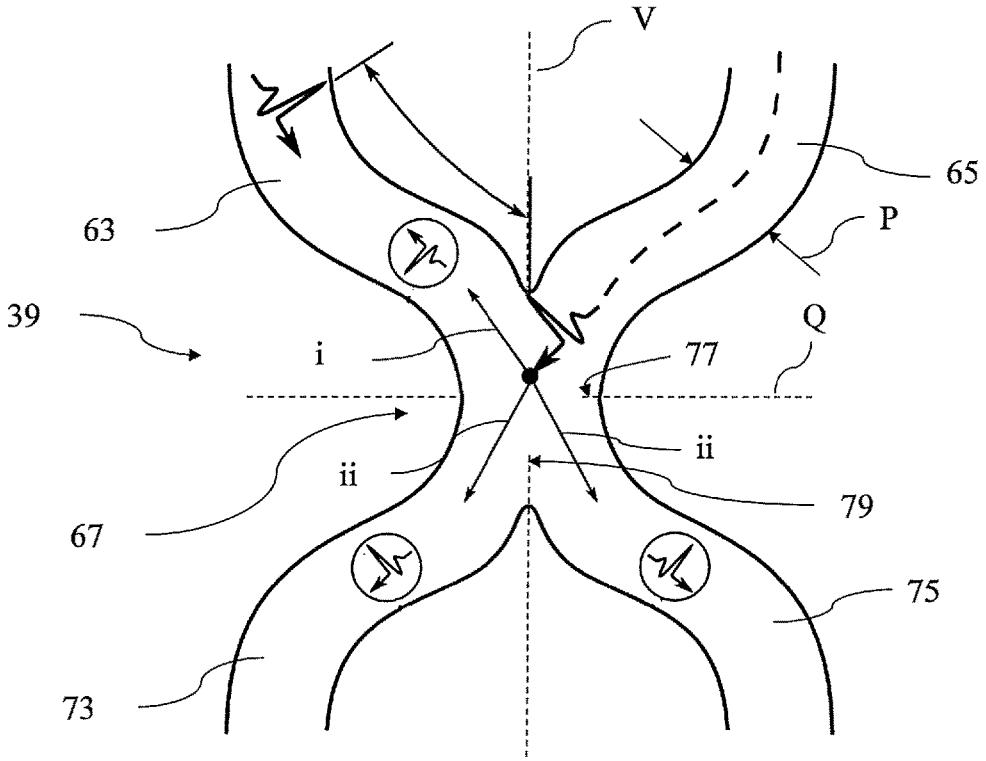
FIG. 4 is a diagrammatic section view of the pipe structure within a middle unifying exhaust subassembly.

In FIG. 4 a more detailed structure of the middle unifying exhaust subassembly 39 (muffler) is shown. The intersection point 67 has a curved inner wall structure being characterized by two minimal cross-section areas, i.e. a horizontal cross-section area 77 and a vertical cross-section area 79. The cross-section areas 77, 79 are designed with a specific relation, particularly the horizontal cross-section area 77 can be smaller than the vertical cross-section area 79. The vertical cross-section 79 can be at least two times as large as the continuous cross-section area P of each of the pipes 63, 65, 73, 75. The cross-section of the horizontal cross-section area 77 can be larger than the continuous section of the respective pipes 63, 65, 73, 75, particularly larger than 1.2 times the cross-section of the pipe 63, 65, 73, 75. The muffler 39 structure realizes a pressure expansion at the intersection point 67. Besides, an improved sound attenuation particularly with respect to specific frequencies is realized.

Exhaust gas is mixed at the intersection point 67 in that a major amount of exhaust gas coming from the right tract 5 is directed into the pipes for the left exhaust tract 3 and vice versa. Further, particularly an internal combustion engine having a multi-cylinder layout, as a boxer structure, has a predetermined firing order and consequently an exact sequence of opening of exhaust valves. Particularly, for a boxer engine having six cylinders, i.e. a left cylinder group I, II, III placed on the left engine side and a right group of cylinders IV, V, VI on the right engine side, a firing order is established by Due to its four stroke process, each piston undertakes two revolutions in order to finish one engine cycle. The sequence between two firings or openings of the respective two exhaust valves is determined by a 120° crank revolution. Therefore, a firing of a cylinder on the one engine side is followed by the firing of the cylinder on the opposed engine side. Since the left and right side of the engine, respectively is connected with the left exhaust tract 3 and the right exhaust tract 5, respectively, exhaust gas branched off within the subassembly 13, 15, are merged together at the earliest within the middle unifying muffler 39 having the specific X-shaped structure. There are at least two important functions taking place at the X-configuration according to the structure shown in FIGS. 2 and 4.

The first function is the pressure pulse effect and its reflection. Due to volume expansion (the cross-section of the pipe structure is enlarged, particularly doubled) positive pressure pulse coming from one exhaust tract branch 3 is being partially inverted into a negative pressure pulse going back on both incoming pipes 63, 65. This reflective negative pressure pulse hits a successive 120° delayed positive pressure pulse. Consequently, pumping losses in the exhaust systems 1 are strongly reduced which positively effects the development of power engine (push-pull effect).

Secondly, the function called exhaust gas stream effect is to be considered. Particularly, under high operation parameters (full load) exhaust gases coming from the respective exhaust branch tract 3, 5 are divided in the intersection point 67 which causes a negative pressure in the respective opposed exhaust pipe, which is called the injector effect. Both phenomena are indicated by the flashes i and ii, respectively, within the intersection point 67.

Figure 3:
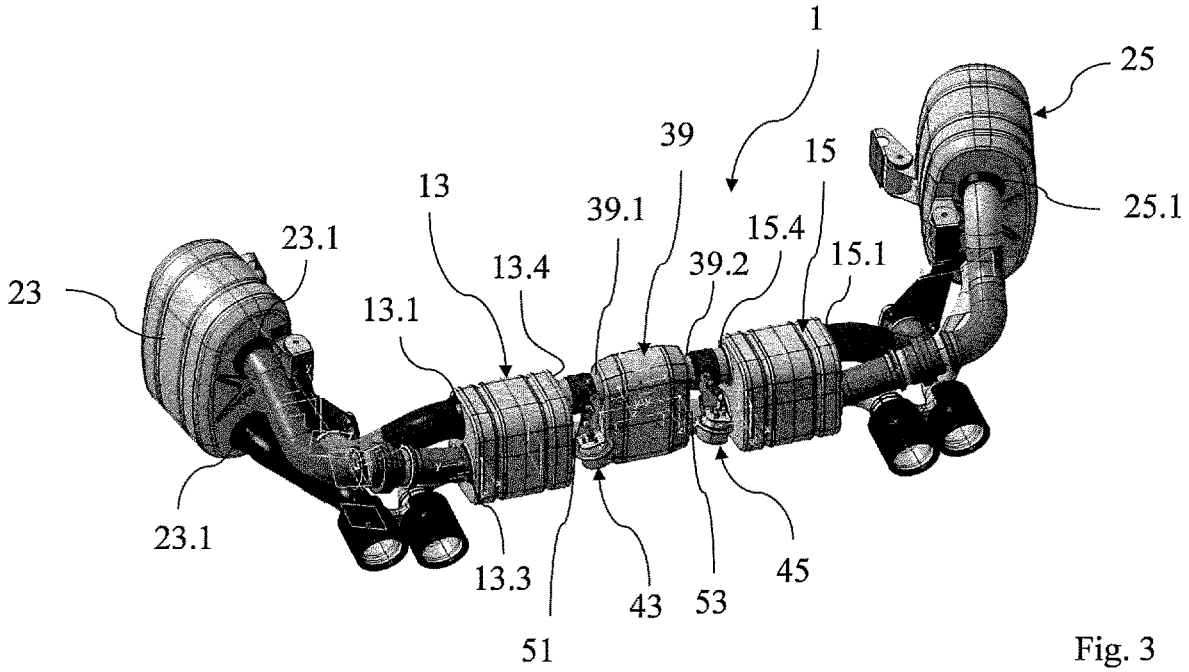
FIG. 3 is a perspective view of a realization of an exhaust system according to the invention, particularly to FIG. 2.

In FIG. 3 a realization of the exhaust system 1 according to an embodiment of the invention is shown, particularly the specific structure for realizing subassemblies, pipes, intersection points, etc., including its housings. The detailed structure of the middle unifying subassembly 39 is hidden by the housing of the subassembly 39.

Figure 5:
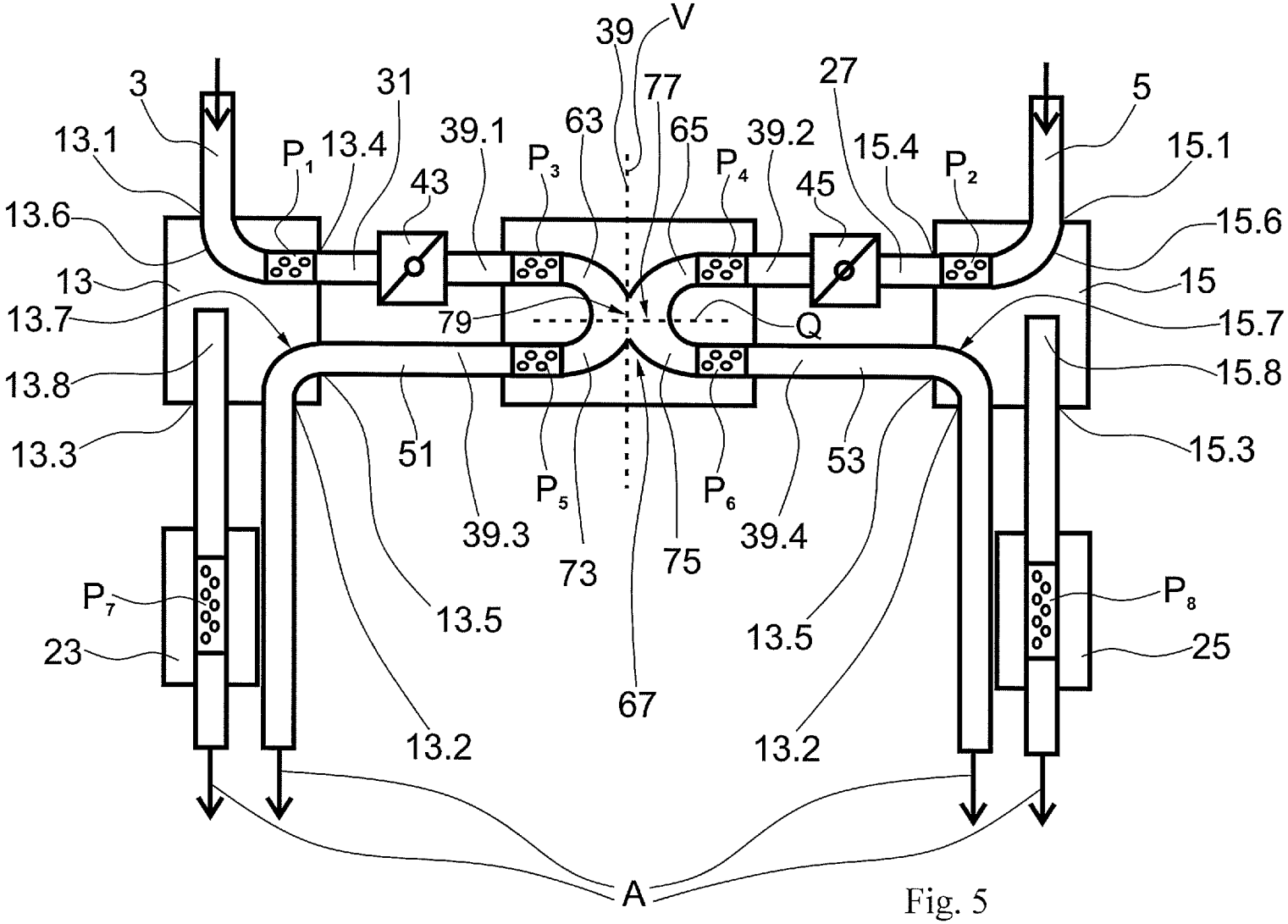
FIG. 5 is a diagrammatic plan of a further, more specific embodiment of the invention.

FIG. 5 shows another realization of the exhaust system 1 according to an embodiment of the invention which is very similar to that illustrated in FIG. 2 but includes some further or alternative details. Specifically, FIG. 5 includes further details with respect to the left and right first exhaust subassembly 13, 15. Therefore, the same reference numerals as used in FIG. 2 are used also in FIG. 5 to identify the same or similar components. For the general description of the exhaust system 1 as illustrated in FIG. 5, reference is made to the above descriptions with respect to FIGS. 1 and 2.

As can be seen, the first, left and right exhaust subassemblies 13, 15, the second left and right exhaust subassemblies 23, 25, as well as the middle unifying subassembly 39 of the embodiment shown in FIG. 5 are all realized as mufflers or silencers. In such an embodiment, an additional catalyzer could for example be arranged upstream from the tract inlets 13.1, 15.1.

The tract inlet pipes 43, 45 of the respective left (3) or right (5) exhaust tract extend into and through the respective left and right exhaust subassembly 13, 15 and exit the left or right exhaust subassembly 13, 15 as the respective left or right interconnecting pipe 27, 31. The channel connecting the tract inlet pipe 43, 45 to the respective left or right interconnecting pipe 31, 27 includes a bended portion 13.6, 15.6 within the first exhaust subassembly 13, 15. Exhaust gas from a tract inlet pipe 43, 45 is led into the respective exhaust subassembly 13 or 15 via a first perforation zone P1, P2. The area of the perforations of the respective first perforation zone P1, P2 is preferably smaller than the continuous cross sectional area of the tube forming the tract inlet pipe 43, 45 and the interconnecting pipe 27, 31. Thus, when the shut-off device 43, 45 is opened, the majority of the exhaust gas from the engine will pass through the respective interconnecting pipe towards the middle unifying subassembly 39. However, when the shut-off device 43, 45 is closed, any exhaust gas that enters the first exhaust subassembly 13, 15 through the tract inlet 13.1, 13.5 will be evacuated from the tract inlet pipe 43, 45 through the first perforation zone P1, P2.

The reconnecting pipe 15.1, 15.3 through which exhaust gas is led from the middle unifying subassembly 39 through the respective left or right branch outlet 39.3, 39.4 can be guided through a pipe which passes through the respective left or right first exhaust subassembly 13, 15 via the respective reconnecting inlet 13.5, 15.5 and the respective exhaust outlet 13.2, 15.2 thereof, without letting any exhaust gas pass from the reconnecting pipe 51, 53 back into first exhaust subassembly 13, 15. However, a reconnecting perforation zone (not shown) could be provided for example at the bends 13.7, 15.7 of the reconnecting pipe 51, 53 leading through the respective left or right first exhaust subassembly 13, 15 for letting exhaust gas pass from the reconnecting pipe 51, 53 into the first exhaust subassembly 13, 15.

The second exhaust gas outlet 13.3, 15.3 of the left or right first exhaust subassembly 13, 15 leads towards a respective left or right second exhaust subassembly 25, 23, which is realized as a muffler and includes a further perforation zone P7, P8 for realizing the muffling or silencing function of the second exhaust subassembly 23, 25.

The respective exhaust gas pipes which lead to the second exhaust subassembly 23, 25 have an inlet opening 13.8, 15.8 arranged within the first exhaust subassembly 13, 15. Exhaust gas from within the first left or right exhaust subassembly 13, 15, for example such exhaust gas that has been evacuated from the left or right inlet pipe 43, 45 through the first perforation zone P1, P2, can be fed through the inlet opening 13.8, 15.8 towards to the second exhaust subassembly 23, 25. In case a reconnecting perforation zone (not shown) is provided in the bend 13.7, 15.7 of the reconnecting pipe 51, 53 exhaust gas to or from the left or right first exhaust subassembly 13, 15 can alternatively be fed into or out of the reconnecting pipe 51, 53 through the reconnecting perforation zone.

In the embodiment shown in FIG. 5, the middle unifying subassembly 39 includes an intersection pipe structure between two incoming pipes 63, 65 and two outgoing pipes 73, 75. The intersection pipe structure has a minimal vertical cross sectional area 79 and a minimal horizontal cross-section area 77 defined by the geometry of the intersecting incoming pipes 63, 65 and outgoing pipes 73, 75. Preferably, the vertical cross-section area is smaller than the horizontal cross-section area. The cross-section areas 77, 79 are designed with a specific relation, particularly the horizontal cross-section area 77 can be larger than the vertical cross-section area 79. The horizontal cross-section 77 can be at least two times as large as the continuous cross-section area of each of the pipes 63, 65, 73, 75. The cross-section of the vertical cross-section areas 79 can be larger than the continuous section of the respective pipe 63, 65, 73, 75. Particularly, the vertical cross-section area 79 is approximately 0.8 times as large as the cross-section area of the pipes 63, 65, 73, 75.

The middle muffler 39 of FIG. 5 has four perforation zones P3, P4, P5, P6. The perforation zones P3, P4, P5 and P6 within the middle unifying subassembly or muffler 39 allow for a gas expansion from within the respective left or right interconnecting pipe 27, 31 to the inside of the middle unifying subassembly-(39)-housing. Each incoming pipe 63, 65 comprises a perforation zone P3, P4 before the beginning of a bend of the respective incoming pipe 63, 65. Each leaving pipe 73, 75 comprises perforations P5, P6 arranged downstream of the intersection point 67 and preferably downstream of the bended portion of the respective left or right leaving pipes 73, 75. The perforation zones P3, P4, P5 and P6 of the incoming and leaving pipes 63, 65, 73, 75 of the middle unifying subassembly 39 allow exhaust gas to pass from the inside of the pipes to their outside within the exhaust gas proof, preferably a gas tight, housing of the middle unifying subassembly 39.

In the embodiment shown in FIG. 5, the left incoming pipes 63 and the left leaving pipes 73 are shaped to form a 180° bended tube. In the embodiment of FIG. 5, the right incoming pipe 65 and the right leaving pipe 75 are bended to realize a 180° bended tube. The left and right 180°-bended-tubes are connected at their respective bending-apex to realize the intersection point 67, preferably in a mirror-symmetrical manner. The x-shaped intersection point 67 realized through this intersection pipe structure improves the exchange of exhaust gas from the left tract inlet pipe 43 to the right reconnecting pipe 53 and, complementarily, from the right tract inlet pipe 45 to the left reconnecting pipe 51.

The features disclosed in the above description, the figures and the claims may be significant for the realization of the invention in its different embodiments individually as in any combination.

The invention claimed is:

1. An exhaust system for an internal combustion automotive engine, comprising:

a left exhaust tract connected or to be connected to a left group of cylinders of the internal combustion automotive engine and a right exhaust tract connected or to be connected to a right group of cylinders of the internal combustion automotive engine, the left and right exhaust tracts, each further comprising— a branching structure defining a tract inlet, at least one exhaust outlet directly or indirectly opening into the atmosphere, and an interconnecting outlet interconnecting said left and right exhaust tracts, wherein said interconnecting outlets are interconnected with each other by a common exhaust gas cleaning and/or silencing device downstream of said interconnecting outlets such that exhaust gas flows coming from said interconnecting outlets are unified within said common exhaust gas cleaning and/or silencing device, and further wherein, said common exhaust gas cleaning and/or silencing device comprises a left and a right interconnecting inlet to which a respective interconnecting pipe is connected and/or said common exhaust gas cleaning and/or silencing device comprises a left returning outlet and a right returning outlet reconnecting the common exhaust gas cleaning and/or silencing device to the respective left and right exhaust tract, the common exhaust gas cleaning and/or silencing device being fitted with two internal intersecting pipes connecting the respective left and right interconnecting inlets with the right and left returning outlets of the common exhaust gas cleaning and/or silencing device and forming an X-formed intersection, wherein the exhaust gas flow branched off within the branching structure, is merged together at the earliest within the common exhaust gas cleaning and/or silencing device having the X-formed intersection.

2. An exhaust system according to claim 1, wherein said common exhaust gas cleaning and/or silencing device comprises a closed housing forming the respective left and right interconnecting inlets and at least two returning outlets for interconnecting and reconnecting the housing with left and right exhaust tract.

3. An exhaust system according to claim 1, wherein the respective branching structure of the left and right exhaust tract is formed by a respective gas exhaust manipulating device, as a left and right gas exhaust cleaning and/or silencing device, respectively.

4. An exhaust system according to claim 1, wherein said left and right branching structure each additionally comprises a reconnecting inlet, reconnecting said common exhaust gas cleaning and/or silencing device with respective left and right branching structure particularly such that a main part of the exhaust gas coming from the respective interconnecting outlet of the respective left and right branching structure is conducted to a respective other reconnecting inlet of the respective right and left branching structure.

5. An exhaust system according to claim 1, wherein said exhaust gas cleaning and/or silencing device comprises an intersection of pipes being coupled to the respective interconnecting outlet, wherein particularly said intersection of pipes is designed such that a pulsatile flow of exhaust gas coming from one interconnecting outlet of the respective branching structure impacts with the pulsatile flow coming from the other interconnecting outlet, within said intersection of pipe such that said pulsatile flows urge each other to said other exhaust tract.

6. An exhaust system according to claim 1, wherein all exhaust gas diverging off at said branching structure from the respective left and right exhaust tract via the interconnecting outlet, enter completely said common exhaust gas cleaning and/or silencing device and particularly completely leaves said exhaust gas cleaning and/or silencing device, wherein particularly respective additional returning outlets are reconnected with respective reconnecting inlets of said branching structure.

7. An exhaust system according to claim 1, wherein said common exhaust gas cleaning and/or silencing device comprises an intersection of pipes including two incoming pipes, two outgoing pipes and an intersection pipe structure having a minimal vertical cross-sectional area and a minimal horizontal cross-sectional area wherein one of the cross-sectional areas, particularly the vertical cross-sectional area, is larger than the respective other one, wherein particularly one of the cross-sectional areas, particularly the horizontal cross-sectional area, is smaller than two times of the preferably continuous pipe cross-section and/or the other cross-sectional area, particularly the vertical cross-sectional area.

8. An exhaust system according to claim 1, wherein the exhaust gas cleaning and/or silencing device comprises an intersection pipe structure providing a flow volume expansion such that a positive pressure of the exhaust gas entering the intersection is at least partially inverted into a negative pressure directed backwards in the direction of the respective interconnecting outlet.

9. An exhaust system according to claim 1, wherein within an interconnecting pipe, coupling the interconnecting outlets of said branching structure to the exhaust gas cleaning and/or silencing device is provided with a shut-off device.

10. An exhaust system according to claim 1, wherein left or right reconnecting pipes connect respective right and left reconnecting outlet of the exhaust gas cleaning and/or silencing device with a respective reconnecting inlet of the branching structure.

11. An exhaust system according to claim 1, wherein exhaust gas flow deviated from the left and right exhaust tract by the branching structure is treated by a cleaning function and/or silencing function of the common exhaust gas cleaning and/or silencing device when being unified and before being re-entered into the common gas flow of the left and right exhaust tract.

12. An exhaust system according to claim 1, wherein the common exhaust gas cleaning and/or silencing device receiving the part of the gas flow of respective left and right tract, treats the exhaust flows and conducts the exhaust flow via the respective returning outlets into reconnecting pipes extending to the reconnecting inlets of the branching structures.

13. An exhaust system according to claim 12, wherein the common exhaust gas cleaning and/or silencing device comprises two incoming pipes extending to an internal common intersection point and two leaving pipes extending to the reconnecting pipes.

* * * * *